United States Patent [19]

Moore

[11] 4,105,252

[45] Aug. 8, 1978

[54] SOLUTION MINING OF MINERALS FROM VERTICALLY SPACED ZONES

[75] Inventor: Thomas F. Moore, Richardson, Tex.

[73] Assignee: Atlantic Richfield Company, Los Angeles, Calif.

[21] Appl. No.: 752,058

[22] Filed: Dec. 20, 1976

[51] Int. Cl.[2] ..... E21B 43/28

[52] U.S. Cl. ..... 299/4

[58] Field of Search ..... 299/4, 5; 166/269

[56] References Cited

U.S. PATENT DOCUMENTS

| | | | |
|---|---|---|---|
| 3,278,232 | 10/1966 | Fitch et al. | 299/4 |
| 3,679,264 | 7/1972 | Van Hulsen | 299/4 |

*Primary Examiner*—Ernest R. Purser
*Attorney, Agent, or Firm*—Ronnie D. Wilson

[57] ABSTRACT

The present invention relates to an improved method for the solution mining of a mineral from a subterranean formation. More specifically, the invention relates to an improved method which enhances significantly the recovery of a mineral via solution mining with an injection and production well from a subterranean formation which contains the mineral in a zone of low permeability having a zone of higher permeability both above and below it. The improvement comprises locating an injection well in one zone of high permeability and a production well in the other zone of high permeability.

8 Claims, 1 Drawing Figure

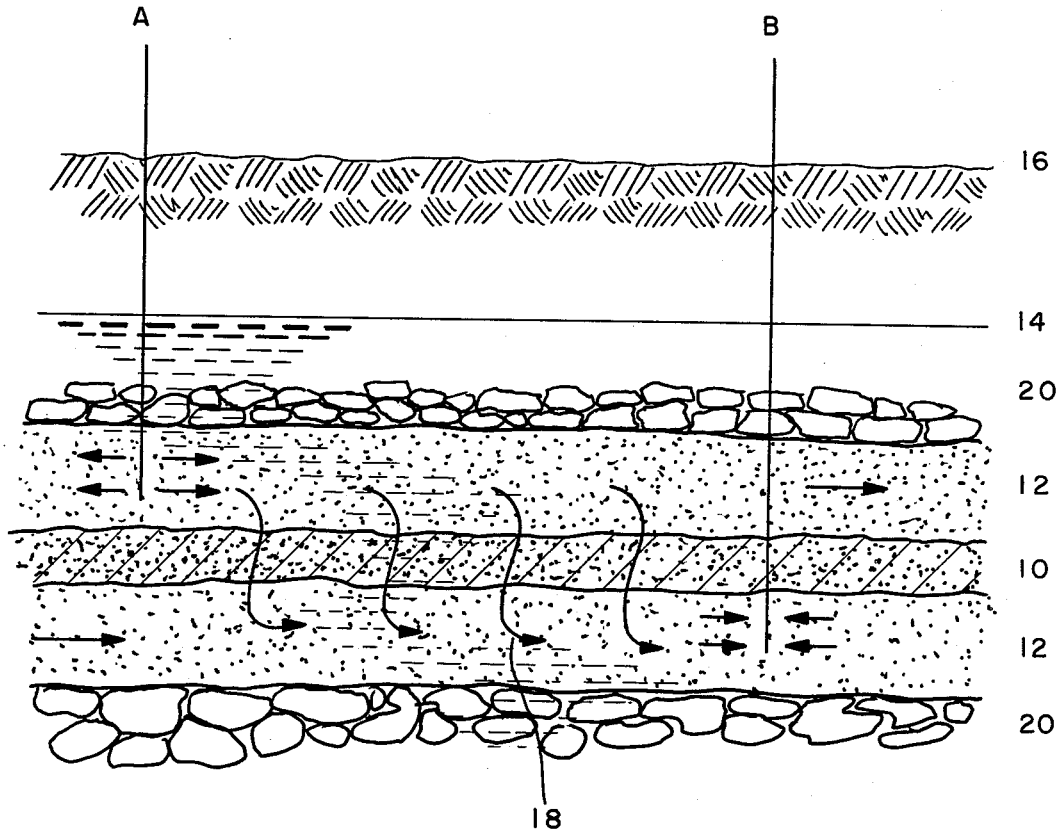
A
B
16
14
20
12
10
12
20
18

SOLUTION MINING OF MINERALS FROM VERTICALLY SPACED ZONES

Generally, known methods for solution mining of a mineral in situ utilize an acid or alkaline leach solution for the dissolution of the mineral. An oxidant is injected into the formation along with the leach solution. The mineral is leached from the formation and recovered from a production well via a pregnant leach solution. Various procedures for recovering the mineral from the pregnant leach solution are well known, such as ion exchange.

The method of the present invention is particularly suitable for the leaching of uranium; however, my invention is not so limited. The following description of the present invention will be applied to uranium leaching; however, it is apparent that it is applicable to leaching other mineral values such as copper, nickel, molybdenum, rhenium, silver, vanadium and selenium where similar problems are encountered.

Although acid leaching solutions can be used in some formations, only alkaline leaching solutions can be used where the particular formation contains significant quantities of acid-consuming gangue.

It is well known that to recover uranium from an underground ore body, it is necessary to convert the relatively insoluble tetravalent state of uranium in the ore to the solubilizable hexavalent state. When using an alkaline leach solution, the dissolution of the uranium in solution occurs in two steps. The first step involves the oxidation of uranium by its reaction with an oxidant and the second the dissolution of the oxidized uranium by the carbonate species in the solution.

During a leaching process, a leach solution is cycled through the formation and follows the path of least resistance to flow namely the zones of high permeability. A mineral in a zone of low permeability in a formation is relatively untouched by the convective flow of the solution. The mineral normally is only contactable by transverse diffusion from the flow of solution parallel to the interface between a zone of low permeability and a zone of high permeability. Injection of leach solution directly into a zone of low permeability does not result in significant recovery because the solution very quickly migrates to zones of higher permeability. Thus, a mineral contained within a zone of low permeability is not recovered to the same extent as that mineral contained within a zone of high permeability. Therefore, there is needed a method whereby a mineral contained in such a zone of low permeability can be recovered along with that mineral which is present in a zone of high permeability.

It has been found that some mineral values (such as uranium) are contained in zones of low permeability (such as clays) which have zones of higher permeability both above and below it (such as porous sands). By establishing a potentail difference between the two porous sands, a vertical component of flow of leach solution can be applied to the clays facilitating recovery of uranium which otherwise would be relatively untouched.

Therefore, it is an object of the present invention to provide an improved method for the solution mining of a mineral from a subterranean formation, applicable generally to minerals that are leachable with either acid or alkaline leach solutions.

A further object of the present invention is to provide an improved method for the solution mining of uranium.

It is an additional objective of the present invention to provide an improved method for the solution mining of uranium from subterranean deposits which contain the uranium in a zone of low permeability having a zone of higher permeability on both sides thereof.

Other objects, aspects, and the several advantages of the present invention will become apparent upon a further reading of this disclosure and the appended claims.

It has now been found that the objects of the present invention can be attained in a method of solution mining a mineral from a subterranean formation containing same in a zone of low permeability having a zone of higher permeability both above and below it in which an injection and production well are drilled and completed wherein a leach solution is injected through the injection well into the formation to dissolve the mineral and recover it via a production well; by locating the injection well in one zone of high permeability and the production well in the other zone of high permeability of the formation.

In the operation of the improved method to recover uranium, the correct location of the wells requires the identification of the various zones and their permeabilities. Utilizing cores cut from boreholes drilled to the ore depth, the zones can be identified by various techniques well known by those skilled in the art, e.g. obtaining porosity/permeability correlations and then using porosity-determining logging tools to obtain porosity and thus permeability data. Therefore, the zone of low permeability containing uranium is identified and the injection and production wells located on opposite sides of same. It does not matter in the present invention whether the injection well or the production well is located on one side or the other of the uranium containing low permeability zone as long as they are on opposite sides thereof. It is also of little significance to the operation of the present invention whether one borehole is utilized for the injection and production wells or whether separate boreholes are used. By locating the wells in the manner prescribed, a potential difference between the two high permeability zones will be established in order to attain flow of leach solution through the mineralized strata of low permeability.

This locating of the wells establishes a vertical component of flow of leach solution through the mineralized strata and therefore results in more recovery of mineral from a given formation than could otherwise be achieved in a specified period of time. It is important to the present invention that the mineralized strata have a permeability of at least 10–30% less than the adjacent zones.

Therefore, through the utilization of the present invention, the percentage of recoverable uranium via in situ leach processes can be enhanced significantly.

The FIGURE illustrates the inventive concepts of the present invention in a simplified manner.

Referring to the FIGURE, line A depicts the injection well and line B the production well. Line 16 depicts the ground level and line 14 the static water level. Lines 20 denote the impermeable over and under burden (such as cap rock). Numbers 12 identify the zones of high permeability (such as porous sand) lying both above and below the zone of low permeability number 10 (such a clay). Number 18 identifies the various flow lines which depict the directions of fluid flow in the formation between the wells.

In carrying out an embodiment of the present invention and referring to the FIGURE, beneath the ground 16 and below the static water level 14 lies a uranium bearing clay stratum 10 having zones of porous sand 12 both above and below it bordered by caprock 20. Initially, injection well A is drilled and completed in the upper zone of porous sand 12. Production well B is drilled and completed in the lower zone of porous sand 12. Subsequently, leach solution is injected via well A into upper zone 12 and pumping via well B of fluids from lower zone 12 is begun. A potential difference is established across the uranium bearing clay stratum 10 causing the solution injected via well A to flow through strata 10 to well B. While flowing through the clay strata 10, leach solution dissolves the uranium present in the clay. A substantial amount of the leach solution is prevented from migrating away from well B into the formation by the over and under burden of caprock 20. Thus, by establishing flow across the clay strata 10, uranium is recovered which would remain relatively untouched by leach solution without utilization of the present invention.

Having thus described my invention, I claim:

1. An improved method for the solution mining of a mineral from a subterranean formation containing same in a zone of low permeability have a zone of higher permeability both above and below it in which an injection and production well are drilled and completed, leach solution is injected through said injection well into said formation to dissolve said mineral, and said dissolved mineral is recovered via said production well, wherein the improvement comprises locating one of said wells in one high permeability zone and the other of said wells in the other high permeability zone to establish a potential difference between said high permeability zones and thereby apply a vertical component of flow of said leach solution to said zone of low permeability facilitating the recovery of said mineral present therein.

2. The improvement of claim 1 wherein said mineral is selected from the group consisting of copper, nickel, silver, vanadium, molybdenum, rhenium, selenium and uranium.

3. The improvement of claim 1 wherein said leach solution is acidic in nature.

4. The improvement of claim 3 wherein said acid leach solution is selected from the group consisting of hydrochloric and sulfuric acid.

5. The improvement of claim 1 wherein said leach solution is alkaline in nature.

6. The improvement of claim 5 wherein said alkaline leach solution is an aqueous solution of one or more salts selected from the group consisting of ammonium carbonate, sodium carbonate, potassium carbonate and their respective bicarbonates.

7. The improvement of claim 1 wherein said mineral containing zone has a permeability of at least 10 to 30% less than said higher permeability zones.

8. The improvement of claim 1 wherein said low permeability zone is clay and said high permeability zones are porous sand.

* * * * *